United States Patent [19]

Tsuchihashi et al.

[11] 4,233,654

[45] Nov. 11, 1980

[54] METHOD OF LIGHTING FOR COLORED SHADOWS

[75] Inventors: Michihiro Tsuchihashi; Masato Saito; Makoto Yamanoshita, all of Amagasaki; Hidetoshi Katsura, Kamakura; Osamu Myodo, Kamakura; Koichiro Maeyama, Kamakura, all of Japan

[73] Assignee: Mitsubishi Denki Kabushiki Kaisha, Tokyo, Japan

[21] Appl. No.: 6,177

[22] Filed: Jan. 24, 1979

Related U.S. Application Data

[63] Continuation of Ser. No. 795,445, May 10, 1977, abandoned.

[30] Foreign Application Priority Data

May 25, 1976 [JP] Japan ..... 51-60315

[51] Int. Cl.[2] ..... F21V 9/00

[52] U.S. Cl. ..... 362/231; 362/252; 362/806

[58] Field of Search ..... 362/231, 252, 249, 806

[56] References Cited

U.S. PATENT DOCUMENTS

| | | | |
|---|---|---|---|
| 3,789,211 | 1/1974 | Kramer | 362/231 |
| 3,805,049 | 4/1974 | Frank et al. | 362/231 X |
| 4,120,026 | 10/1978 | Tsuchihashi et al. | 362/231 |
| 4,125,888 | 11/1978 | Tsuchihashi et al. | 362/231 |
| 4,138,714 | 2/1979 | Tsuchihashi et al. | 362/231 |

*Primary Examiner*—Stephen J. Lechert, Jr.
*Attorney, Agent, or Firm*—Oblon, Fisher, Spivak, McClelland & Maier

[57] ABSTRACT

Beautifully and balanced colored shadows can be imparted by arranging an R unit for light sources for yellow to red; a G unit for light sources for green and a B unit for light sources for violet to blue with each predetermined space wherein each unit comprises a plurality of light sources in each group adjacent each other.

4 Claims, 3 Drawing Figures

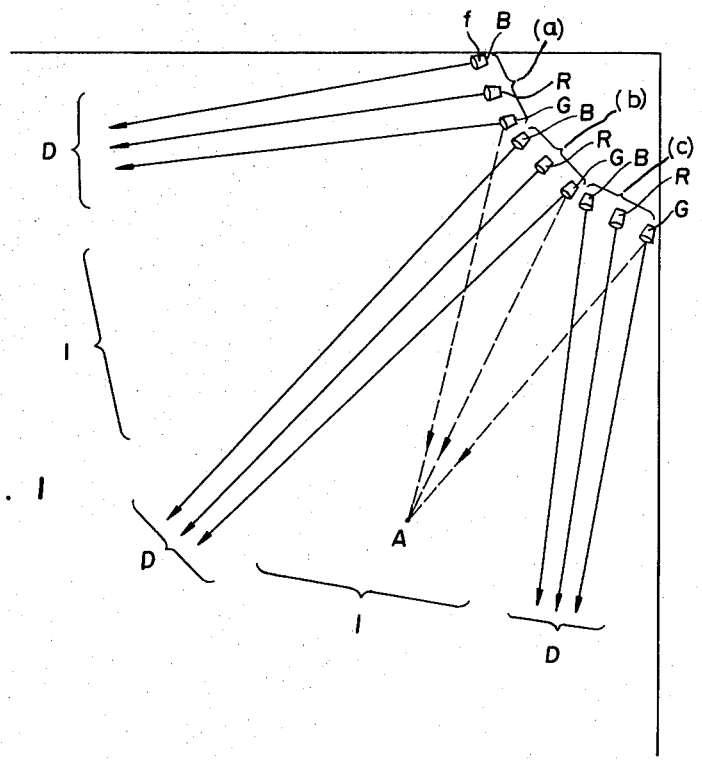
FIG. 1
FIG. 2
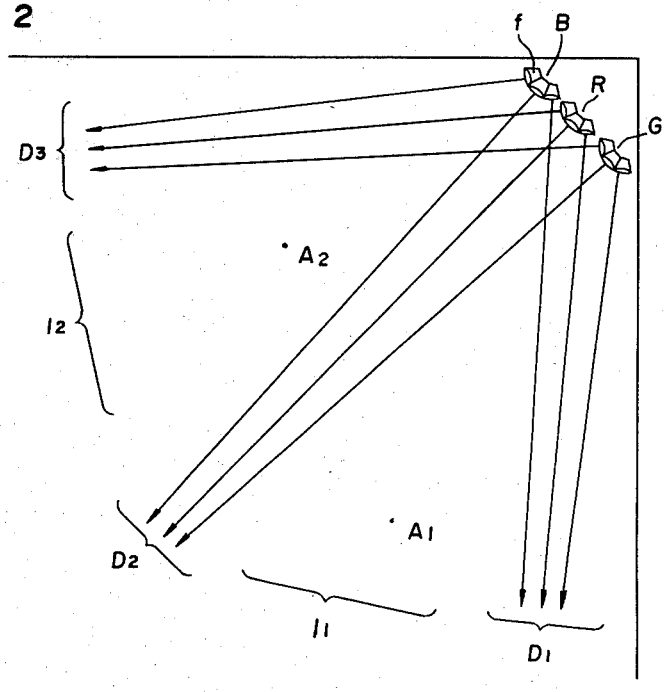

METHOD OF LIGHTING FOR COLORED SHADOWS

BACKGROUND OF THE INVENTION

This application is a continuation of application Ser. No. 795,445, filed May 10, 1977, and now abandoned.

The present invention relates to an improved method of lighting for colored shadows by employing color lamps, more particularly, it relates to an arrangement of color light sources so as to obtain beautifully colored shadows in all parts of relatively wide region.

When an object in front of white wall is illuminated by color lamps, the shadow of the object is formed behind the object on the wall. The shadow of the object caused by one color lamp, is colored depending upon the other color lamp used for illuminating the shadow part.

When the shadow of the object caused by one color lamp, is illuminated by two or more other kinds of color lamps, the colors at the shadow are dependent upon the additive mixture of color by the color lamps. However, in order to impart beautifully colored and balanced shadows, by the conventional arrangements of color lamps, the region of lighting is relatively narrow. Accordingly, it is difficult to impart beautiful and balanced colored shadows in a relatively wide region.

SUMMARY OF THE INVENTION

It is an object of the present invention to provide a method of lighting to impart beautiful and balanced colored shadows in all parts of a relatively wide region.

The object of the present invention can be attained by providing a method of lighting for colored shadows utilizing the effect of the colored shadows of an object by arranging color light sources in three R, G and B groups of at least one light source for yellow to red (R group); at least one light source for green (G group) and at least one light source for violet to blue (B group), wherein a plurality of color light sources in each group are adjacent each other so as to form an R unit for the light sources in R group; a G unit for the light sources in G group and a B unit for the light sources in B group and the R, G and B units are arranged with predetermined spacing so as to illuminate predetermined directions in a wide region.

BRIEF DESCRIPTION OF THE DRAWINGS

FIG. 1 is a schematic view showing the conventional arrangements of lamps;

FIGS. 2 and 3 are respectively schematic plan and front views showing the arrangements of lamps according to the present invention.

DETAILED DESCRIPTION OF THE PREFERRED EMBODIMENTS

Figure 3:
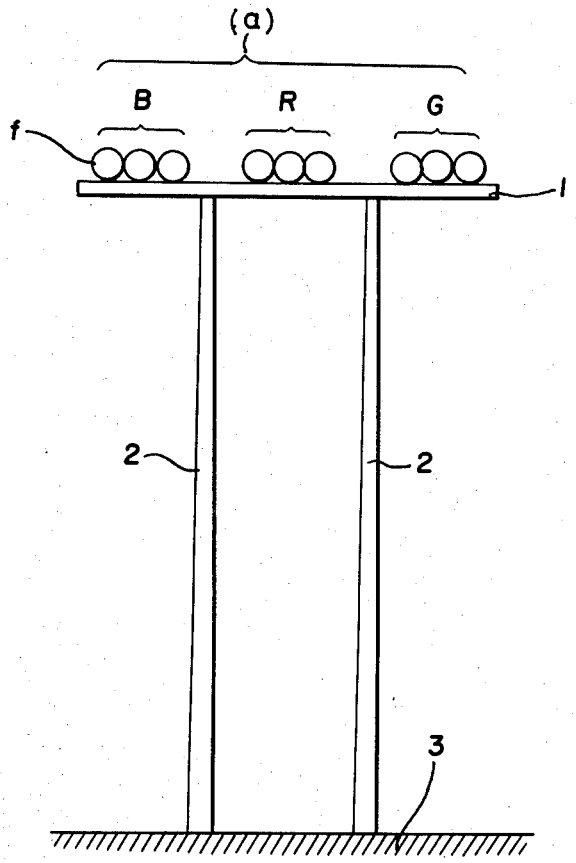

In the specification, the light sources are described as lamps.

FIG. 1 shows the conventional embodiment for imparting beautifully colored shadows in a relatively wide region by employing color lamps in three R, G and B groups.

In order to impart beautiful shadows, the object is simultaneously illuminated by color lamps in three R, G and B groups and the ratio of illuminances of the other color lamps at the shadows of the object caused by the lamp, is given in the specific range and the spaces between a shadows of the object by the color lamps are given in the specific range.

Under said conditions, in the embodiment of FIG. 1, the three color lamps in the three R, G and B groups are set as one unit to be fixed in each floodlight (f) equipped at the top of each lighting pole and the color lamps in each unit are matched to each direction (D) and three units (a), (b), (c) are arranged so as to give relatively wide illuminated region.

In the conventional cases, beautiful and balanced colored shadows of the object can be obtained in a region for the direction (D), however, the object is illuminated by the color lamps in each unit by superposing the lights in the region (I) between the regions for adjacent directions (D), (D). Accordingly, as illustrated by the case of lighting an object at the point (A) in the region (I) of FIG. 1, the lights of the color lamps in the G groups are given from three directions separated from each other as shown by the dotted lines and the lights of the color lamps in the R group and the lights of the color lamps in the B group are respectively given from three directions whereby three times as many colored shadows appear, as a phenomenon of shadows doubling. In the phenomenon, the contours of shadows are blurred without forming clear contours and the beauty of the shadows is lost.

Accordingly, in the conventional embodiment, even though beautifully colored shadows can be obtained in relatively narrow regions, it is difficult to obtain beautifully colored shadows in a relatively wide region because of said phenomenon.

FIGS. 2 and 3 show one embodiment according to the present invention wherein a high pressure sodium lamp is used as the light source in the R group; a green metal halide lamp (thallium halide is added) is used as the light source in G group and a blue metal halide lamp (indium halide is added) is used as the light source in the B group, and the snow surface of a skiing field in a relatively wide region is illuminated by said color lamps in three R, G and B groups so as to obtain beautifully colored shadows of skiers.

Referring to FIGS. 2 and 3, the embodiment of the present invention will be illustrated.

An arm (1) is held on lighting poles (2), and equipped with clusters or units of floodlights (f) in which the floodlight in each cluster have color lamps in the same group and three units or clusters having color lamps in different groups are arranged in spaced apart relationship as for example 1.5 m. That is, the G unit having three adjacent color lamps in the G group, the R unit having three adjacent color lamps in the R group and the B unit having three adjacent color lamps in the B group, are respectively arranged with each group spaced from the other by spaced by 1.5 m so as illuminate disposed in three directions ($D_1$), ($D_2$), ($D_3$) from each of the units.

In accordance with the embodiment, the colored shadows of skiers on snow surface are beautifully colored in the regions to the three directions ($D_1$), ($D_2$), ($D_3$) and the shadows of skiers at the position ($A_1$) in the region ($I_1$) between ($D_1$) and ($D_2$) and the position ($A_2$) in the region ($I_2$) between ($D_2$) and ($D_3$) are also illuminated by the adjacent lights of the colored lamps in three groups. Thus, the R, G, and B units can be considered as substantially the same light sources whereby the phenomenon of shadows doubling is not substantially found for the shadows of skiers at the positions ($A_1$), ($A_2$) so as to obtain beautifully colored shadows at the positions.

When the floodlights (f) are coated with paints having the same colors with those of the the color lamps, as red for the floodlight (f) of R unit; green for the floodlight (f) of the G unit and blue for the floodlight (f) of the B unit; the color shadow lighting by color light sources can be easily found and the replacement of the colored lamps can be easily attained because the kind of the colored lamp can be easily found.

As described above, in accordance with the present invention, beautifully colored shadows can be obtained in all parts of a relatively wide region of the skiing field, etc. whereby scenery of the skiing field, etc. can be changed to be marvelous which result could not be attained by the conventional lighting without colored shadows.

In the embodiment, the method of lighting on a snow surface in the skiing field has been illustrated. However, the method of the present invention can be applied for the lighting in a place for imparting beautifully colored shadows in all parts of relatively wide region.

In these cases, the basic layout of the arrangement of flood-lights is shown in FIG. 2 and the layout can be modified to face the floodlights back to back; to be semicircular; opposite side spacing; to be staggered spacing or to be a combination thereof.

In the embodiment, three floodlights having three color lamps are used in each unit. The sizes and shapes of the floodlights can be modified as desired and the floodlights can be assembled in each unit and the number of the color lamps in each unit can be selected to be two or more depending upon the region for illumination, the lighting characteristics of the floodlights, the wattages of the lamps and the illuminance required at the illuminated surface. It is also possible to use reflector type lamps without employing floodlights.

The distance between adjacent units of the R, G and B units can be selected as desired depending upon illuminated objects and shapes of shadows required. The angle of the color lights from the corresponding lamps of adjacent units can be also selected as desired depending upon illuminated object and shapes of shadows required.

The color lamps in the R group include a yellow color lamp, an orange color lamp, a red color lamp, a high pressure sodium lamp, an orange metal halide lamp (sodium halide is added) and a red metal halide lamp (lithium halide is added); and the light sources or devices for producing orange to red color have a front colored filter, glass plate, plastic film and so on, to give color lights being the same with those of the color lamps.

The color lamps in the G group include a green color lamp and a green metal halide lamp (thallium halide is added); and the light sources or devices for producing color green have a front colored filter to give color lights being the same with those of the color lamps.

The color lamps in the B group include a violet color lamp, a blue color lamp, a violet metal halide lamp (gallium halide is added) and a blue metal halide lamp (indium halide is added); and the light sources or devices for producing color violet to blue which have a front colored filter to give color lights being the same with those of the color lamps.

As described above, in accordance with the present invention, the arrangement of color lamps is modified in the color-shadow lighting for beautifully colored shadows by the color light sources in three R, G and B groups, whereby beautifully colored shadows can be obtained without the phenomenon of a shadows doubling in all parts of relatively wide region and the applications for illumination are further improved. The effect in the practical application is remarkably high.

What is claimed as new and desired to be secured by letters patent of the United States is:

1. A method of obtaining sharply defined and illuminated color shadows, comprising the steps of:

arranging first, second and third light sources in spaced apart relationship;

providing a plurality of closely adjacent color lights in each of said first, second and third light sources, with the color lights in the first light source producing light for yellow to red colors, the color lights in the second light source producing light for green color, and the color lights in the third light source producing light for violet to blue colors; and orienting the plurality of lights in the first, second and third light sources so that one light from each light source is aimed in a first direction to thereby obtain illumination of an area with light from each of the three light sources, and aiming at least another light from each of the light sources in at least another direction to thereby obtain illuminatin of another area with light from each of the three sources, each such area therefore being illuminated as if by light from a common source and the phenomenon of shadow doubling thus being avoided.

2. A method as in claim 1, including the steps of arranging three closely adjacent color lights in each of the three light sources, and disposing said color lights in each light source at an angle relative to one another, whereby each light is aimed at a different one of three spaced areas, one of the lights in the respective light sources being aimed at one of the areas, another of the lights in the respective light sources being aimed at another of the areas, and the third light in the respective light sources being aimed at the third area.

3. A method as in claim 2, including the steps of spacing the light sources apart from one another by 1.5 meters.

4. A method as in claim 1, including the steps of coating the lights with a color film having the same color as the lights, whereby a non-operative light can be easily ascertained and located.

* * * * *